United States Patent [19]

Martens

[11] Patent Number: 4,710,112

[45] Date of Patent: Dec. 1, 1987

[54] AUGER CONSTRUCTION FOR MACHINES FOR FORMING HOLLOW CORE CONCRETE SLABS

[75] Inventor: Ernst Martens, Winnipeg, Canada

[73] Assignee: Alphair Ventilating Systems Inc., Winnipeg, Canada

[21] Appl. No.: 945,949

[22] Filed: Dec. 24, 1986

[30] Foreign Application Priority Data

Dec. 31, 1985 [GB] United Kingdom ..... 8531919

[51] Int. Cl.[4] ..... B28B 21/52

[52] U.S. Cl. ..... 425/64; 264/211.21; 366/50; 366/323; 425/208; 425/224; 425/426

[58] Field of Search ..... 425/62–64, 425/200, 204, 206–209, 218, 219, 224, 426–429, 432; 264/69–72, 167, 211.21, 349; 366/50, 318, 323

[56] References Cited

U.S. PATENT DOCUMENTS

| | | | |
|---|---|---|---|
| 3,146,508 | 9/1964 | Berliner et al. | 425/114 |
| 3,181,222 | 5/1965 | Palmer | 425/64 |
| 3,858,856 | 1/1975 | Hsu | 366/88 |
| 3,926,541 | 12/1975 | Hewitt | 425/64 |
| 4,000,884 | 1/1977 | Chung | 366/88 |
| 4,022,556 | 5/1977 | Goetjen | 425/64 |
| 4,063,718 | 12/1977 | Koch | 425/205 |
| 4,067,676 | 1/1978 | Hewitt | 425/64 |
| 4,084,928 | 4/1978 | Petersik | 425/64 |
| 4,133,619 | 1/1979 | Wise | 425/64 |
| 4,330,242 | 5/1982 | Putti | 425/64 |

FOREIGN PATENT DOCUMENTS

| | | |
|---|---|---|
| 623476 | 7/1961 | Canada . |
| 720048 | 10/1965 | Canada . |

*Primary Examiner*—Jay H. Woo
*Assistant Examiner*—J. Fortenberry
*Attorney, Agent, or Firm*—Stanley G. Ade; Adrian D. Battison

[57] ABSTRACT

An auger assembly is provided which includes a core, the surface of which increases in diameter from the upstream end towards the downstream end. The auger flighting upon the core, however, maintains a constant diameter from the upstream end towards the downstream end so that the depth of flighting gradually decreases to zero at the downstream end. This means that the maximum thrust against the concrete being augered occurs at a negative angle of approximately 105°, said thrust being at right angles to the surface of the core. This produces a negative flow of the concrete thus contradicting the free concrete flow required in order to provide the necessary bond between the concrete and the cables. The present invention reduces this surface angle to an angle of approximately 90°, or having the surface substantially parallel to the longitudinal axis. The forming mandrel is preferably provided with an inclined surface formed by the diameter of the mandrel decreasing slightly from the upstream end to the downstream end. If a finishing mandrel is included, this also tapers towards the downstream end because of the diameter decreasing from the upstream end towards the downstream end all of which give improved performance of the auger assemblies in such machines.

14 Claims, 6 Drawing Figures

AUGER CONSTRUCTION FOR MACHINES FOR FORMING HOLLOW CORE CONCRETE SLABS

BACKGROUND OF THE INVENTION

This invention relates to new and useful improvements in rotatable augers used in the manufacture of hollow core concrete slabs.

These slabs are formed from a relatively dry concrete mix in a machine moveable along a fixed casting bed by the extruding action of the slab from the machine onto the fixed bed.

Conventionally, such machines utilize a plurality of rotating auger assemblies mounted within an open ended enclosure with a hopper receiving the concrete mix feeding by gravity into one end of the enclosure, being compressed and compacted by the rotating augers in a mould chamber, passing over a trowelling member and then being deposited rearwardly of the machine in the form of a smooth surfaced multi-apertured concrete slab normally having pre-stressed or post-stressed reinforcing wires or cables extending longitudinally therethrough.

Conventionally, such augers of existing technologies are structured so that the diameter of the external core around which the auger flight is situated, constantly increases towards the downstream end of the auger to a maximum diameter at or near the point where the auger flight ceases. This allows the combined forces of compression and compaction to be exerted on the relatively dry concrete material. Compression is caused by the increasing of the diameter of the outer core of the auger in the form of a tapered cylinder, moving concrete material into a smaller and smaller area within the mold chamber of the machine.

Compaction is effected by a high frequency vibrator imparting energy throughout the entire surface of the auger and imparting an increasingly greater effect on the concrete material as it approaches the downstream end of the auger. In addition, further vibration may be provided to the upper or hammer plate of the mould chamber by an exterior vibrator directly or indirectly acting on the hammer plate.

The combination of these two forces, compaction and compression, is essential to the moulding of the concrete material into its final consolidated form and each of these forces acts in concert with the other but has an increasing effect on the material as it proceeds along and over the downstream part of the auger.

These conventional augers have an outside core which has a constant increase in the diameter of the external core at an angle of approximately 10°–15° to the longitudinal axis of the core, reaching the maximum at the downstream portion of the auger where the auger flights runs out, it being understood that the external diameter of the auger flighting remains substantially constant. The principal difficulty with conventional auger constructions is the difficulty in obtaining the guaranteed bond of the reinforcing strands or cables, with the concrete. This is because the conventional auger with a gradually increasing taper to the outer diameter of the core leads towards the production of a negative flow of the concrete thus contradicting the free concrete flow required in order to provide the necessary bond, due to the slope of the core surface between flights being rearwardly or opposite to the relative movement between the concrete and the core.

PRIOR ART

There is a considerable amount of prior art for machines of this type using augers in combination with a moulding chamber forming part of an assembly which moves forwardly along a bed extruding the finished product therebehind and these machines include the follows:

U.S. Pat. No. 3,159,897 Ellis et al incorporated by reference into this application.

U.S. Pat. No. 3,284,867 Booth.

U.S. Pat. No. 3,781,154 Herbert et al.

U.S. Pat. No. 3,877,860 Putti.

U.S. Pat. No. 4,022,556 Goetjen.

U.S. Pat. No. 4,133,619 Wise.

All of these show an auger assembly which includes a core increasing in diameter from the upstream end towards the downstream end and having an auger flight thereon with a constant outside or peripheral diameter so that the depth of flight gradually decreases from the upstream end towards the downstream end.

Other U.S. Patents include U.S. Pat. Nos. 3,146,508, 4,067,676, and 3,926,541 all of which show conventional augers having a core and flighting of a constant diameter.

U.S. Pat. No. 3,181,222 shows a machine in which the cores for the slab bores are withdrawn after forming and compaction is relied upon for compression of the concrete.

U.S. Pat. No. 3,740,176 shows a slab-forming device utilizing a vertically positioned feeder band which is rolled out of synchrony with the speed of advancement of the container and U.S. Pat. No. 4,084,928 shows a slip-forming arrangement for concrete barriers not utilizing an auger assembly.

The present invention overcomes difficulties inherent with conventional augers by providing what is defined as a "step-core." In other words the overall increase in diameter of the core is present but it appears as a plurality of steps between adjacent flights when viewed in side elevation, with the surfaces of these steps being substantially parallel to the longitudinal axis of the auger and to the outer line of the auger flights rather than at an inclined angle thereto. In actual fact, the diameter of the core gradually increases as in the prior art but the surface of the core between the flights is always preferably approximately parallel to the longitudinal axis of the core.

This presents several advantages over conventional technology. The new design increases the cubic content of each flight significantly thereby allowing additional concrete material to be handled by the auger.

This results in more material being progressively subjected to the compression and compaction forces and reaches a maximum at the downstream end of the auger where the material is in its final position to be formed by the mould sides and the smoothing mandrels on the downstream ends of the auger assemblies.

This provides a more positive bond with the reinforcing strands or cables, with a slower extrusion speed together with less wear on the augers and provides a construction which requires a smaller number of parts.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
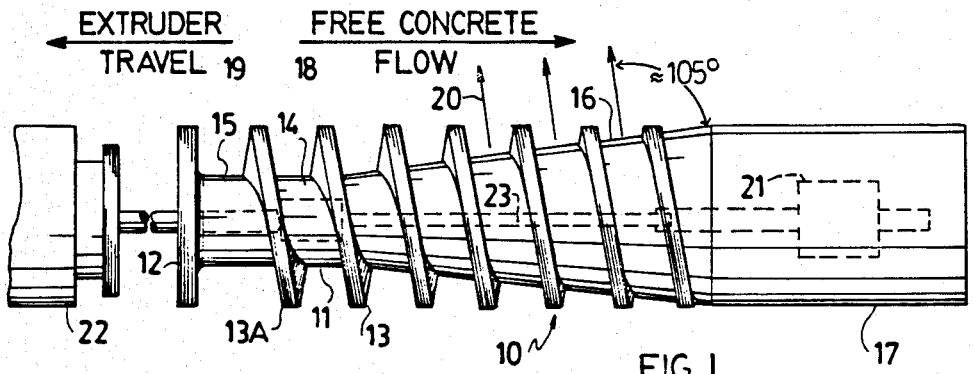
FIG. 1 PRIOR ART
FIG. 1 is a side elevation of a conventional auger assembly together with the vibrator drive motor shown schematically.

Proceeding therefore to describe the invention in detail, reference character 10 illustrates generally, a conventional auger comprising a core 11 of substantially circular cross-section with an attaching flange 12 situated at the inner end thereof, it being understood that the core is substantially hollow and is cast with an auger flight 13 around the outer surface of the front portion thereof.

The first two flights 13A of the auger flighting surrounds an inner end portion 14 of the core which is of a constant diameter insofar as the outer surface 15 is concerned.

The central core portion 16 then gradually expands in diameter to form a truncated conical portion, the angle of which gradually increases at an averate rate of approximately 10°–15° to the longitudinal axis terminating in an enlarged or maximum diameter rear portion 17 which defines the maximum diameter of the bore formed within the concrete block formed by the device.

Such devices are well known in the art and are exemplified by U.S. Pat. Nos. 3,159,897, 3,605,217, 3,284,867, 3,781,154 and 4,022,556 previously discussed.

It will be noted that the free concrete flow, in conventional auger assemblies is in the direction of arrow 18 with the extruder traveling in the opposite direction as indicated by arrow 19 so that the direction of compression of concrete surrounding this rotating auger assembly is in the direction of arrows 20 or negative to the direction of free concrete flow indicated by arrow 18.

Conventional auger assemblies utilize a vibrator assembly 21 within the forming mandrel portion 17 driven by a vibrator drive motor 22 situated rearwardly of the auger and connected to the vibrator-impeller by an elongated drive shaft 23 which extends together with suitable support bearings and couplings, axially through the entire length of the each of the auger assemblies.

Figure 2:
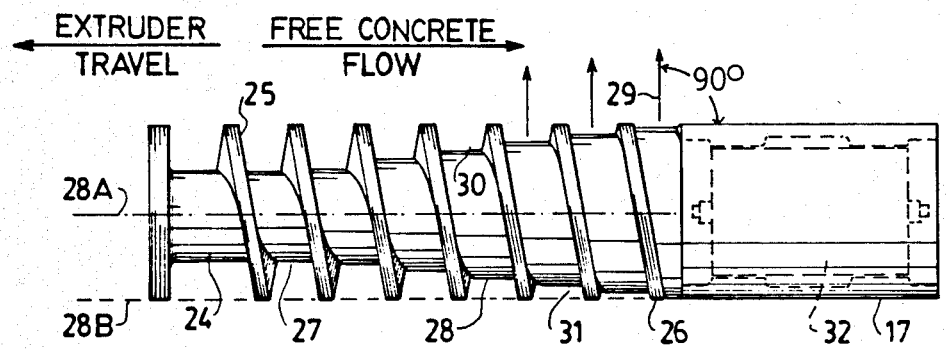
FIG. 2 is a side elevation of the new auger assembly of the present invention.
Figure 3:
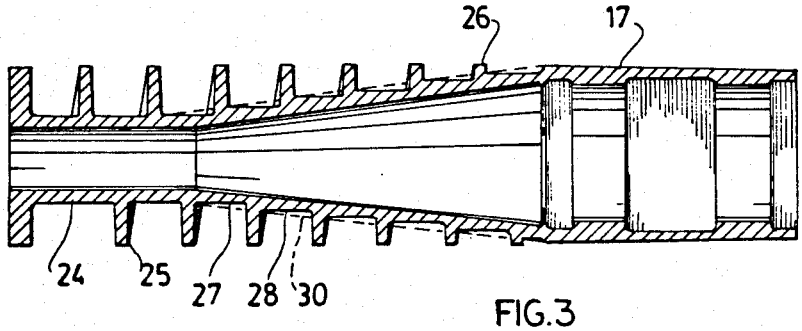
FIG. 3 is a cross-sectional view of the auger assembly of FIG. 2 with the vibrator deleted.
Figure 4:
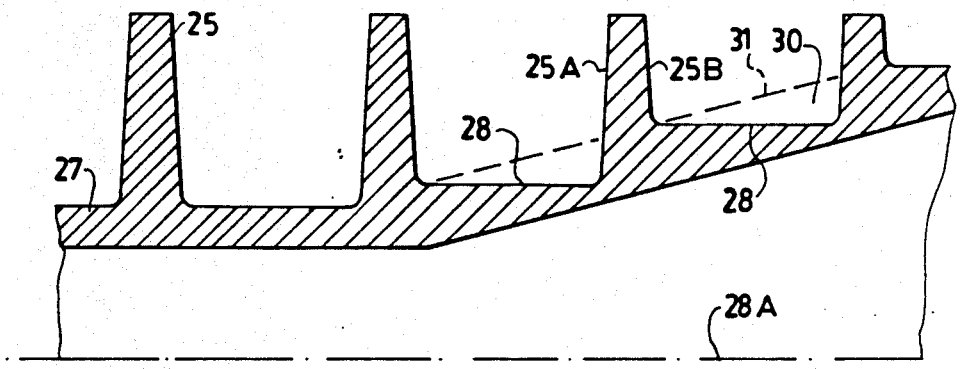
FIG. 4 is an enlarged fragmentary longitudinal cross-sectional view of part of the new auger.

The improved auger construction illustrated in FIGS. 2, 3 and 4 also includes a hollow core 24 with an auger flight 25 formed therearound and with the outer diameter of the auger flight remaining constant from the leading or upstream end 25A to where it disappears at the trailing or downstream end at 26 as the diameter of the main rear portion is substantially equal to the diameter of the flight 13.

The first two flights includes a core portion 27 which is of a constant diameter but then the core gradually and smoothly increases in diameter between adjacent flights 25, which appears as a series of steps between adjacent flights 25 when viewed in side elevation because the outer surface 28 of the core is always parallel to the longitudinal axis of the auger and to a line drawn through the outer perimeter or surface of each of the auger flights indicated by reference characters 28A and 28B respectively. However, it will be appreciated that this surface, although remaining parallel to 28A and 28B, smoothly and regularly increases in diameter between the beginning and end of the increased diameter core. This also means that the forward or leading face of the flight is always deeper than the corresponding trailing face portion thereof as indicated in FIG. 4 at 25A and 25B respectively.

This produces several advantages. Firstly, the angle of compression indicated by arrows 29, is substantially at 90° to the direction of the free concrete flow and the longitudinal axes 28A of the augers. Although 90° is shown in the drawings, nevertheless it will be appreciated that advantages are realized as long as this angle approaches 90° as near as is possible. Secondly, an increased capacity of concrete is provided as shown by the areas indicated by reference character 30. These volumes are the volumes existing between the present surface 31 of existing augers and the parallel surface 28 (relative to the longitudinal axes of the cores) of the improved auger assembly and is clearly shown in FIG. 4.

This gives a guaranteed bond between the concrete and the reinforcing cables (not illustrated) as the concrete flow has a direct impact-compaction relationship to the pre-stressed cable and the surrounding packing chamber instead of a negative flow from the existing augers as previously described.

Compaction, which is caused by the high frequency vibrator (at least 22,000 vibrations per minute) shown schematically by reference character 32 imparts energy throughout the entire surface of the auger and has an increasingly greater effect on the concrete material as it approaches the downstream end of the auger. Therefore by including the core design which is substantially parallel to the center line 28A of the auger core and to the outer diameter of the downstream end of the auger (28B), the combined resulting compression and compaction forces are improved with the result that these essential forces are exerted on the concrete material in a manner which does not counteract the flow of the material itself.

By the incorporation of the new auger design, the cubic content of each flight is significantly increased allowing additional material to be handled by the auger. This increase in cubic content of each auger flight and thus an increase in the concrete material handled, progressively increases towards the downstream end of the auger flights and is of particular importance in the last two auger flights of the downstream end of the auger which is where the maximum combination of compaction and compression takes place.

The increase in cubic capacity achieved by this new mechanism is approximately 5% to 7% in the first auger flight but progressively improves so that the increase on the last auger flight at the downstream end is approximately 40% to 50%. This results in more material progressively subjected to the compression and compaction forces which reaches a maximum in the downstream end of the auger where the material is in its final position to be formed.

Another advantage of the present invention is the provision of the internal vibrator shown schematically at 32 in FIG. 2. This rotates with the auger or may be stationery if the mandrel portion 17 is also stationery and completely eliminates the connecting shafts and couplings thereby reducing maintenance and breakdowns.

The improved auger assembly may be provided in two different types namely, an assembly which is the same length and is provided with the same internal dimensions as conventional auger assemblies except that the pitch and the parallel surfaced core is incorporated so that it can be retro-fitted into existing machinery or it can be a parallel surfaced auger with the same diameter as existing auger assemblies but with a different length to accommodate the internal vibrator 32 therewithin. Machinery can be altered to accept these longer auger assemblies or, alternatively, they can be incorporated in a new construction.

Maximum compression and compaction of the concrete material is achieved at the point towards the downstream end 26 of the auger where the auger flights cease and the core diameter becomes parallel to the mould chamber walls or longitudinal axis 28A of the auger assembly. As the concrete material moves past this point, it continues to be moulded into its final cross section by the downstream end of the auger assembly which is a cylindrical core 17 or a forming element of various shapes and by the vibration of this core together with the vibration imparted by the hammer plate which is the top section of the mould chamber (not illustrated).

The concrete material in its final cross sectional shape (see FIG. 6) is supported as it passes through the final section of the mould chamber by follower tubes or mandrels 33 which are attached to the auger assembly or the forming element 17 but isolated by means of a rubber vibration dampener 34 from the vibration of the auger or the top plate of the mould chamber.

It is natural for the concrete material or slab 35 which is under maximum compression and compaction to relax slightly after it has left the mould chamber where it has been supported by the auger assembly, the forming element and the follower tube or tubes, and it will do so where it is easiest to achieve—namely in the interior of the hollow cores 36 within the total cross section and in that section of the total cross section 37 above the hollow cores.

Figure 6:
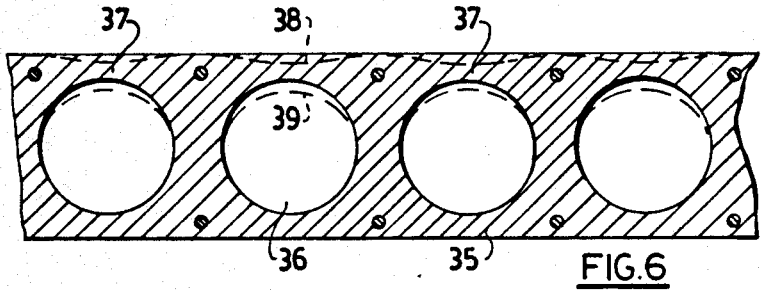
FIG. 6 is an end view of a formed slab.

The result is a wavy top surface to the cross section of formed concrete material and a slightly reduced dimension to the hollow cores as shown (exaggerated) in dotted lines 38/39 in FIG. 6.

This growth or relaxation of the concrete material is first noticed at the point within the mould chamber at the end of the auger or forming element and the leading edge 40 of the follower tube as the tube is 0.50" to 0.100" smaller in diameter than the auger or forming element—done so as to allow the concrete material to flow over the follower tube without tearing.

This sudden relaxation of the concrete material in its formed cross section causes the cross section at the top of the hollow cores to drop onto the follower tube and leave a void between the top of the mould chamber and top surface of the concrete material without the possibility of filling this void as the concrete material is in its final cross section.

Figure 5:
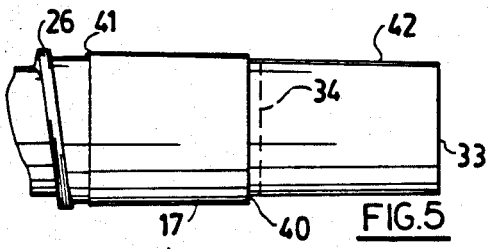
FIG. 5 is a view similar to FIG. 2 but illustrating a preferred embodiment.

In order to overcome this undesirable feature and in recognition of the fact that the concrete material at its maximum compression and compaction will tend to relax naturally, the auger assembly and the forming element, as well as the follower tube, are manufactured with a slight constantly reducing diameter taper 41 and 42, towards the downstream end of the total assembly beginning at a point approximately one to four inches after the auger flights cease—the point at which maximum compression and compaction occurs. The outer surface of this approximately one inch after the auger flights cease is parallel to the longitudinal axis 28A of the auger assembly and is indicated at 41 in FIG. 5.

This improvement to the downstream end of the auger assembly permits the forming section with its internal vibration, together with the vibration of the top portion of the mould chamber, to add additional material to the top surface of the cross section thereby controlling the gradual growth of the concrete material into a dimensional accurate cross section and eliminating the wavy top surface of the formed slab.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An auger assembly for use in machines used for forming hollow core concrete slabs; said auger assembly comprising in combination an auger core having an upstream end and a downstream end, and an auger flighting on the outer surface of said auger core, the diameter of said flighting remaining substantially constant throughout the length thereof, the diameter of said auger core increasing from the upstream end to the downstream end thereof, whereby the depth of the flighting gradually decreases from a maximum at the upstream end to a minimum at the downstream end, the surface of said auger core between said flighting being substantially parallel to the longitudinal axis of said auger core and including a product core forming mandrel extending axially from the downstream end of said auger core.

2. The assembly according to claim 1 in which the diameter of said auger core is constant for at least the distance between the first two flight revolutions of said flighting.

3. The assembly according to claim 1 in which the depth of said flighting is substantially zero at the downstream end thereof, the depth of the flighting on said auger core being deeper on the leading side thereof than on the trailing side thereof.

4. The assembly according to claim 2 in which the depth of said flighting is substantially zero at the downstream end thereof, the depth of said flighting on the portion of said auger core which increases in diameter, being deeper on the leading side thereof than on the trailing side thereof.

5. The assembly according to claim 1 in which the diameter of said product core forming mandrel increases constantly from adjacent the upstream end thereof towards the downstream end thereof.

6. The assembly according to claim 1 in which the diameter of said product core forming mandrel decreases constantly from adjacent the upstream end thereof towards the downstream end thereof.

7. The assembly according to claim 5 in which the portion of the upstream end of said product core forming mandrel immediately following the downstream end of said auger core is substantially similar in diameter to said downstream end of said auger core thereby having an outer surface parallel to the longitudinal axis of said auger assembly.

8. The assembly according to claim 1 which includes a finishing mandrel extending axially from the downstream end of said product core forming mandrel.

9. The assembly according to claim 8 in which the diameter of said finishing mandrel decreases constantly from the upstream end thereof towards the downstream end thereof.

10. The assembly according to claim 8 in which the diameter of the upstream end of said finishing mandrel is less than the diameter of the downstream end of said product core forming mandrel.

11. The assembly according to claim 9 in which the diameter of the upstream end of said finishing mandrel is less than the diameter of the downstream end of said product core forming mandrel.

12. The assembly according to claim 1 in which the preferred angle between the surface of said auger core and the longitudinal axis of said assembly is approximately 90°.

13. The assembly according to claim 4 in which the preferred angle between the surface of said auger core and the longitudinal axis of said assembly is approximately 90°.

14. The assembly according to claim 7 in which the preferred angle between the surface of said auger core and the longitudinal axis of said assembly is approximately 90°.

* * * * *